US009903640B2

(12) United States Patent
Curtis

(10) Patent No.: US 9,903,640 B2
(45) Date of Patent: Feb. 27, 2018

(54) STORAGE MODULE WITH BUILT-IN CAP OPENER

(71) Applicant: Electrolux Home Products, Inc., Charlotte, NC (US)

(72) Inventor: Brent Aaron Curtis, Charlotte, NC (US)

(73) Assignee: Electrolux Home Products, Inc., Charlotte, NC (US)

( * ) Notice: Subject to any disclaimer, the term of this patent is extended or adjusted under 35 U.S.C. 154(b) by 43 days.

(21) Appl. No.: 14/736,301

(22) Filed: Jun. 11, 2015

(65) Prior Publication Data

US 2016/0363365 A1 Dec. 15, 2016

(51) Int. Cl.

| | |
|---|---|
| ***A47B 96/04*** | (2006.01) |
| ***F25D 23/04*** | (2006.01) |
| ***F25D 23/02*** | (2006.01) |
| ***F25D 23/06*** | (2006.01) |
| ***F25D 25/02*** | (2006.01) |
| *B67B 7/16* | (2006.01) |

(52) U.S. Cl.

CPC ..... *F25D 23/04* (2013.01); *F25D 23/021* (2013.01); *F25D 23/062* (2013.01); *F25D 25/021* (2013.01); *B67B 7/16* (2013.01); *F25D 2331/803* (2013.01)

(58) Field of Classification Search

CPC ..... F25D 23/04; F25D 23/021; F25D 23/062; F25D 25/021; F25D 2331/803; B67B 7/16

USPC ..... 312/402, 404, 405.1

See application file for complete search history.

(56) References Cited

U.S. PATENT DOCUMENTS

| | | | | | |
|---|---|---|---|---|---|
| 1,060,674 | A | * | 5/1913 | Foster | |
| 1,090,422 | A | * | 3/1914 | Stovall | |
| 1,547,578 | A | * | 7/1925 | Frisone | |
| 1,880,985 | A | * | 10/1932 | Saunders | B67B 7/16 292/340 |
| 1,929,855 | A | * | 10/1933 | Saal | |
| 2,454,531 | A | * | 11/1948 | Trine | B67B 7/16 81/3.08 |
| 2,540,756 | A | * | 2/1951 | Radcliffe | B65D 25/20 220/592.03 |
| 2,565,775 | A | * | 8/1951 | Mendenhall | |
| 2,892,367 | A | * | 6/1959 | Burdick, Jr. | |
| 2,990,972 | A | | 7/1961 | Benedetti | |
| 3,055,541 | A | | 9/1962 | Bonkowski | |
| 4,335,814 | A | | 6/1982 | Benning et al. | |

(Continued)

FOREIGN PATENT DOCUMENTS

| | | |
|---|---|---|
| CN | 103 994 622 A | 8/2014 |
| DE | 20 2004 018 162 U1 | 4/2006 |

(Continued)

OTHER PUBLICATIONS

International Search Report and Written Opinion of Corresponding Application No. PCT/US2016/033710; dated Aug. 11, 2016.

*Primary Examiner* — Daniel J Troy
*Assistant Examiner* — Timothy M Ayres
(74) *Attorney, Agent, or Firm* — Pearne & Gordon LLP

(57) ABSTRACT

A storage module for storing a closed beverage container within a refrigerator including a storage bin, an opener affixed to the storage bin and configured to open the closed beverage container, and an attachment portion configured to removably attach the storage bin to a wall of the refrigerator.

9 Claims, 5 Drawing Sheets

(56) References Cited

U.S. PATENT DOCUMENTS

| | | | | |
|---|---|---|---|---|
| 5,265,501 | A * | 11/1993 | Reyes | B65F 1/06 81/3.08 |
| 7,293,846 | B2 * | 11/2007 | Collins | F25D 23/04 220/661 |
| 7,334,853 | B2 | 2/2008 | Ahmed et al. | |
| 2008/0083301 | A1 * | 4/2008 | Messina | B65F 1/12 81/3.08 |
| 2011/0079110 | A1 * | 4/2011 | Previte | B67B 7/16 81/3.15 |

FOREIGN PATENT DOCUMENTS

| | | |
|---|---|---|
| JP | S44 7176 Y1 | 3/1969 |
| JP | S53 33065 U | 3/1978 |

* cited by examiner

STORAGE MODULE WITH BUILT-IN CAP OPENER

CROSS-REFERENCE TO RELATED APPLICATIONS

Not applicable.

TECHNICAL FIELD

The present disclosure relates generally to a refrigerator storage module, and more particularly, to a bottle storage module having a bottle opener incorporated into an outer surface of the module.

BACKGROUND

The inside portion of a refrigerator generally includes organizational and storage elements, for example shelves built into an interior wall of a fresh food or freezer compartment, for example the interior of a refrigerator door. Shelves as described enable a user to organize and store food and/or beverages within the refrigerator, for example by providing a storage bin, wherein the user can select the interior location to place food and/or beverage items. The storage elements of a refrigerator are useful to the extent of holding items, such as bottled beverages, until a later time. Once an item is removed, a storage element is typically no longer of use to the user with respect to the removed item.

Bottled beverages are commonly stored within a refrigerator so that the contents are chilled to a desired temperature when the user removes them for use. To access the contents of a bottled beverage, the user opens the bottle by removing a closing member such as a bottle cap using a bottle opener. Upon removal, the user can dispose of the bottle cap by, for example, placing the cap into a nearby trash or recycling receptacle, typically doing so immediately following removal.

SUMMARY

The following presents a simplified summary of the disclosure in order to provide a basic understanding of some example aspects described in the detailed description.

The present invention is directed to a storage module for use within a fresh food or freezer compartment of a refrigerator. The storage module can be one of multiple storage modules which are arranged on the interior portion of a refrigerator door. The storage module can be removably attached to the interior portion, for example by hooking the storage module into an interior door rail system. The location of the storage module can be adjusted by removing the module and placing the module into another location on the interior rail system.

The storage bin can be configured for receiving items to be stored, for example the storage bin can include one or more walls, dividers, and/or retainer bars to prevent the stored items from falling out of the storage module. Items to be stored can be food or beverage items such as bottled beverages. Bottled beverages are generally closed by crimped caps, which may be removed. For example, a user may remove the cap with a bottle opener by deformation of a certain extension of the crimped peripheral edge of the cap. The storage module can include a bottle cap opener attached to the storage module. In a preferred embodiment, the present invention allows a user to take a capped bottle from a storage module situated within fresh food compartment and open the capped bottle using the bottle opener attached to the storage module. In one embodiment, the bottle opener is attached to the front wall of the storage module, wherein the bottle opener faces at least partially downward and a compartment for catching and storing removed caps is positioned to capture the removed closing member when the closed beverage container is opened with the opener. As such, the present invention provides a convenient bottle opener and storage for removed caps.

Additional features and advantages of the invention will become more readily apparent from the following detailed description of a preferred embodiment thereof when taken in conjunction with the drawings wherein like reference numerals refer to corresponding parts in the several views.

In one aspect, a storage module for storing a closed beverage container within a refrigerator is disclosed including a storage bin, an opener incorporated into a side of the storage bin, for example a wall, wherein the opener is configured to remove a closing member of the closed beverage container from the closed beverage container, and a compartment portion positioned to capture the removed closing member when the closed beverage container is opened with the opener. The compartment portion can be a hollow cavity within the wall incorporating the opener. The wall of the storage bin incorporating the compartment portion can be removably coupled to the storage bin such that the user can remove the wall from the main body of the storage bin to empty the contents of the compartment portion within the wall. The opener can be incorporated into the front-facing wall of the storage bin. In one embodiment the wall of the storage bin is transparent. In one embodiment, the storage module can include an attachment portion configured to removably attach the storage bin to a wall of the refrigerator.

In another aspect, a storage module is provided including an opener wherein the opener comprises an angle bracket and an opener member. The opener member can be incorporated into the angle bracket. In one aspect, the angle bracket can be affixed to the storage bin, for example the angle bracket can be affixed to a top portion of the wall of the storage bin incorporating the opener. The angle bracket can include a first member and a second member which meet to form an acute angle. In one aspect, the opener member can be attached to the second member of the angle bracket. The second member of the angle bracket can be positioned such that the removed closing member falls into the compartment portion when the closed beverage container is opened with the opener member. In another aspect, the opener portion can be incorporated into the second member of the angle bracket positioned such that the removed closing member falls into the compartment portion when the closed beverage container is opened with the opener.

In another aspect, a storage module for storing a closed beverage container within a refrigerator is provided, including a storage bin, an opener affixed to the storage bin, wherein the opener is configured to remove a closing member of the closed beverage container from the closed beverage container, an attachment portion configured to removably attach the storage bin to a wall of the refrigerator, and a compartment portion positioned to capture the removed closing member when the closed beverage container is opened with the opener. The opener can be incorporated into a wall of the storage bin, and the compartment portion can be positioned within the wall of the storage bin incorporating the opener. In another aspect, the wall incorporating the opener can be removably coupled to the storage bin such that the user can remove the wall from the main body of the storage bin to empty the contents of the compartment portion contained therein. The opener can include an opener member positioned such that the removed closing member falls into the compartment portion when the closed beverage container is opened with the opener member.

In yet another aspect, a refrigerator can include a refrigerator cabinet including a door, and a storage module for storing a closed beverage container, wherein the storage module is attached to an interior wall of the refrigerator cabinet, comprising a storage bin and an opener, wherein the opener is configured to remove a closing member of the closed beverage container from the closed beverage container. The storage module can also include a compartment portion positioned to capture the removed closing member when the closed beverage container is opened with the opener. The compartment portion can be a hollow cavity within a wall of the storage bin, for example the front-facing wall. In one aspect, the opener can be incorporated into a wall of the storage bin, for example the front-facing wall. The wall of the storage bin incorporating the compartment can be removably coupled to the storage bin such that the user can remove the wall from the storage bin to empty the contents of the compartment portion contained therein. The storage module can be integral with the interior wall of the refrigerator cabinet or can be separately and/or removably attached.

It is to be understood that both the foregoing general description and the following detailed description present example and explanatory embodiments of the invention, and are intended to provide an overview or framework for understanding the nature and character of the invention as it is claimed. The accompanying drawings are included to provide a further understanding of the invention and are incorporated into and constitute a part of this specification. The drawings illustrate various example embodiments of the invention, and together with the description, serve to explain the principles and operations of the invention.

BRIEF DESCRIPTION OF THE DRAWINGS

These and other aspects are better understood when the following detailed description is read with reference to the accompanying drawings, in which.

DETAILED DESCRIPTION

Figure 1:
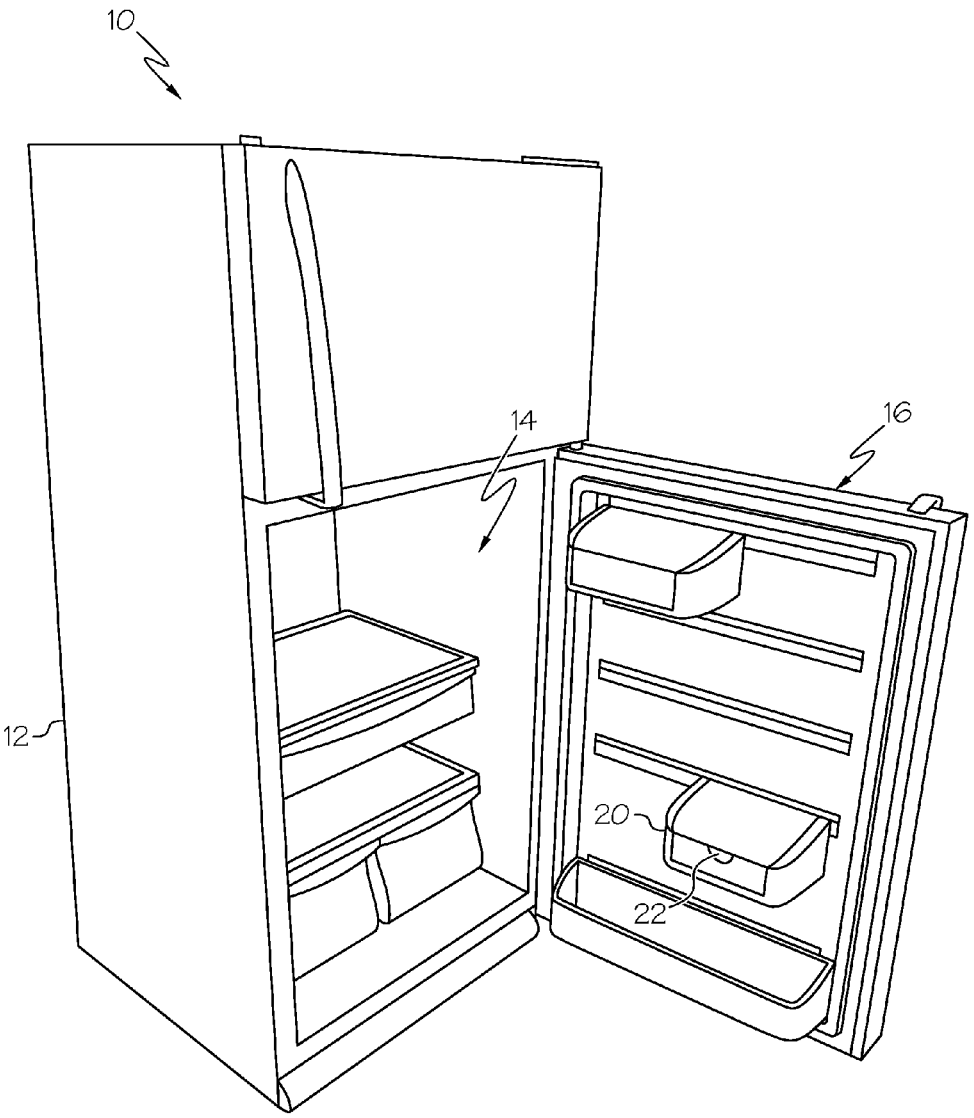
FIG. 1 is a perspective view of the inner portion of the fresh food compartment of a top mount refrigerator comprising a storage bin comprising a bottle opener removably attached thereto.

Examples will now be described more fully hereinafter with reference to the accompanying drawings in which example embodiments are shown. Whenever possible, the same reference numerals are used throughout the drawings to refer to the same or like parts. However, aspects may be embodied in many different forms and should not be construed as limited to the embodiments set forth herein.

Referring now to FIG. 1, an example apparatus 10 is shown comprising a cabinet 12 defining an enclosure 14. The apparatus 10 in the present example is an appliance and, more specifically, a refrigerator with a fresh-food compartment and a top-mount freezer compartment, the enclosure 14 being the fresh-food compartment. However, in some embodiments, the apparatus 10 can be a refrigerator with an alternative arrangement of compartments or a refrigerator with a single compartment. The apparatus 10 can be any cabinet-like structure that comprises a cabinet defining an enclosure. The refrigerator 10 can have a refrigeration system that maintains the fresh food compartment at temperatures above 0° C. and the freezer compartments at temperatures below 0° C. The fresh food compartment can store food items such as fruits, vegetables, and beverages and the freezer compartment can store food items that are to be kept in a frozen condition.

The arrangement of the fresh food and freezer compartments with respect to one another in such refrigerators vary. For example, in some cases, the freezer compartment is located above the fresh food compartment (i.e., a top mount refrigerator), and in other cases the freezer compartment is located below the fresh food compartment (i.e. a bottom mount refrigerator). Many modern refrigerators have their freezer compartments and fresh food compartments arranged in a side-by-side relationship. Additionally, some refrigeration appliances have either a fresh food compartment only or a freezer compartment only. A door 16 can provide access to one or more of the compartments. As shown in FIG. 1, a door 16 provides access to the fresh food compartment 14. The door 16 is pivotally coupled to a cabinet of the refrigerator to restrict and grant access to the fresh food and freezer compartments. While the present application is described herein by way of an example top mount refrigerator configuration with freezer compartment located above the fresh food compartment and closed by another door, it is contemplated that other refrigerator configurations can be used, such as bottom-mount refrigerators having at least one door.

A storage bin 20 can be associated with the refrigerator. As shown, the storage bin 20 can be removably mounted to the door 16 by, for example, a hook on the back of the storage bin that can engage a rail on the door 16. Alternatively, the storage bin can be mounted to a structure of the fresh food compartment. The storage bin can include an opener 22.

Figure 2:
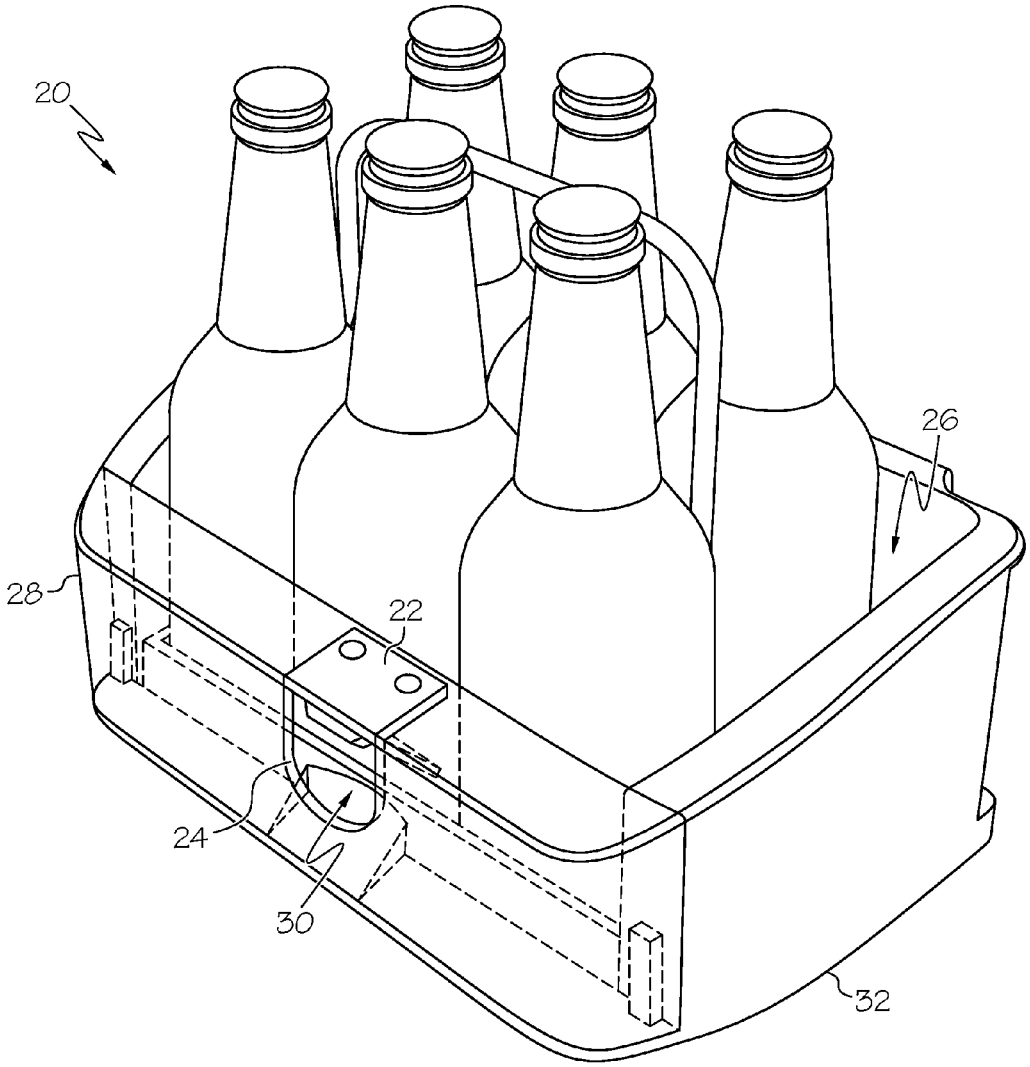
FIG. 2 is a perspective view of a storage bin.

Turning to the shown example of FIG. 2, the refrigerator storage bin 20 incorporating the opener 22 is illustrated. As shown, the bin 20 can have a plurality of sides, for example four sides, and a bottom defining a storage space 26. In another embodiment, the storage bin 20 can include less than four sides, for example a shelf with a retainer bar (not shown). In a preferred embodiment, the bin 20 can include a detachable front wall 28 and a main body 32 comprising three sides and a bottom. As illustrated, one side of the bin 20 can incorporate an opener 22. For example, the opener 22 can be incorporated into the front wall 28 positioned such that a user can place the capped end of a bottle in contact with the opener 22 and access the opener 22 to remove the bottle cap. In a preferred embodiment, the opener 22 is incorporated to the upper center portion of the front wall 28. In some cases, the opener 22 is incorporated into a side wall or bottom of the storage bin 20.

As illustrated, the front wall 28 can include an internal compartment portion 30 to capture removed caps. For example, the compartment portion 30 can be a hollow cavity within the front wall 28 of the storage bin 20 positioned to capture the removed closing member when the closed beverage container is opened with the opener 22. The compartment 30 provides collection and storage for the removed caps so that the user can dispose of the removed caps at a time of the user's convenience.

In one embodiment, the compartment portion 30 can be separable from the storage bin 20 and/or main body 32 for allowing the user to dispose of any removed caps contained therein without having to detach and remove the entire bin 20 from its location within the refrigerator. As shown, the compartment portion 30 can be positioned within the removable front wall 28 which can be removed and oriented such that the compartment portion 30 is emptied of its contents. In one embodiment, the front wall can include an opening 24 which provides the user access to a portion of the opener 22 positioned within an internal portion of the front wall 28. In a preferred embodiment, a user can insert the capped end of a bottled beverage through the opening 24 in order to utilize the opener 22 to remove the cap thus positioned within the front wall 28. Upon removal, the cap can then fall, for example vertically downward, into the compartment portion 30 for storage until disposal at a later time.

As shown, the front wall 28 of the storage bin 20 can be transparent such that the contents of the compartment 30 within the front wall 28 can be seen by a user. As such, in a preferred embodiment, the compartment portion 30 can fill up with removed caps as the user opens more bottles and be later emptied of the one or more collected caps. The dimensions of the compartment 30 can vary as one skilled in the art would recognize, for example to accommodate a plurality of removed caps.

Figure 3:
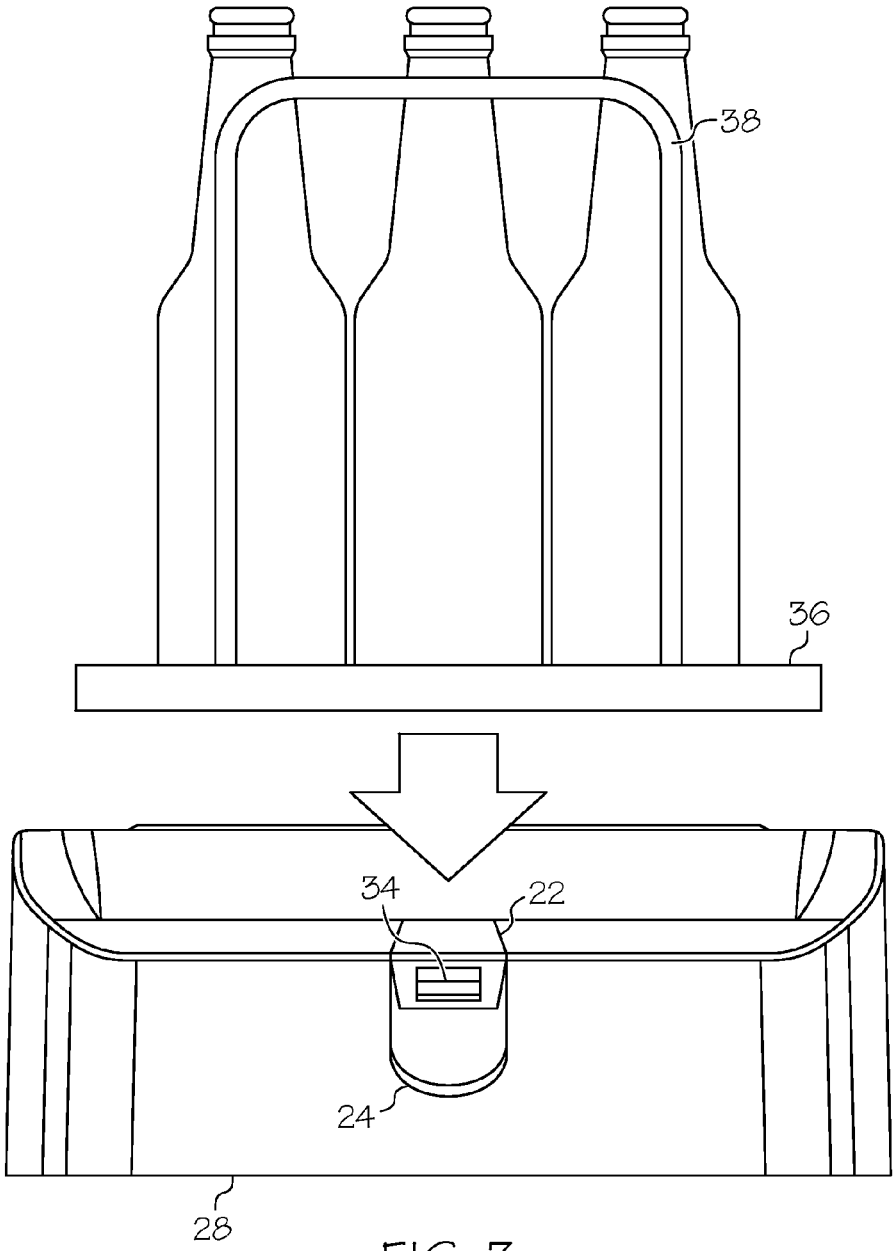
FIG. 3 is a perspective view of a storage bin with a corresponding removed storage caddy.

Referring now to FIG. 3, the front wall 28 can incorporate an opener 22 configured to remove a closing member of a closed beverage container from the closed beverage container. For example, the opener 22 can be a bottle opener configured to remove a bottle cap. The opener 22 can be located, for example, at the top and center of the front wall 28. In a preferred embodiment, the bottle opener 22 can comprise a piece of metal acting as an opener member 34 by catching the lid of the cap of a bottled beverage. In one embodiment, an opening 24 in the front-facing side of the storage bin 20 provides the user access to the opener member 34. For example, the user can insert the capped portion of a bottle into the hollow cavity portion of the front wall 28 to access the opener member 34 present therein. In operation, the capped bottle is inserted through the opening 24 such that a crimped edge of the bottle cap is placed in contacting relation with the edge of the opener member 34. The edge of the opener member 34 can engage the crimped edge of the bottle cap. In some cases the opener member 34 is positioned such that to then remove the cap from the bottle, it only requires the movement of the bottom of the bottle toward the front wall 28. In other cases, the opener member 34 is positioned such that the user moves the bottom of the bottle in a direction other than toward the front wall.

As illustrated, one embodiment of the invention is a storage bin 20 which includes a removable caddy 36, for example to transport one or more bottles. In some cases, a formed wire handle 38 can be incorporated to prevent the remaining bottles from falling over when a bottle is removed from the caddy 36 and to aid the user in transportation of the bottles. In one embodiment, the storage bin 20 comprises at least one divider creating slots for a plurality of individual bottles, for example six bottles.

Figure 4:
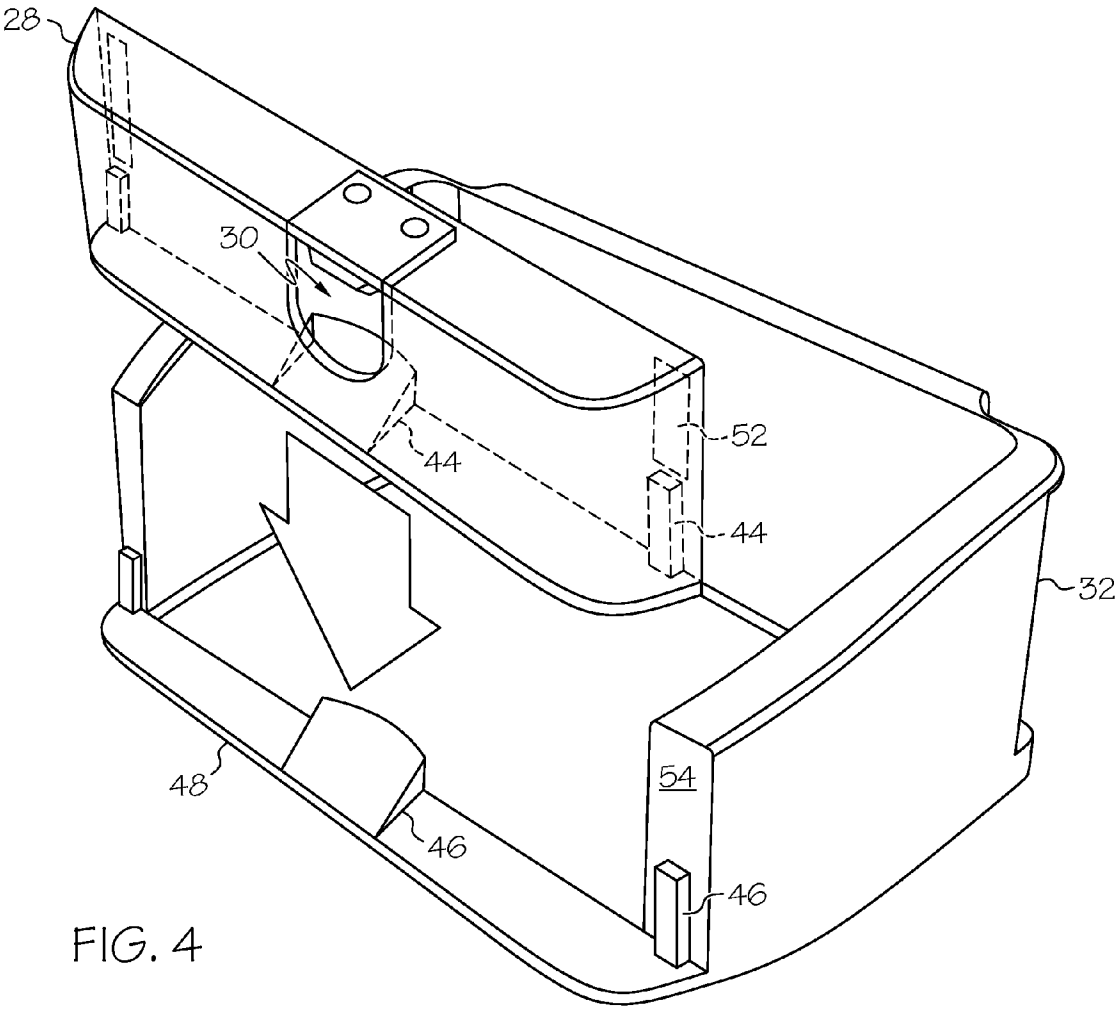
FIG. 4 is a perspective view of a storage bin with a corresponding detached front wall.

Referring now to FIG. 4, the front wall 28 can be removable to allow for disposal of the collected caps contained within the internal compartment 30. In one embodiment, the front wall 28 can slide out of place, for example in an upward direction, and can be oriented above a trash or recycling receptacle such that the collected caps fall out of the compartment 30 into the receptacle. As shown, the front wall 28 can include mating portions which attach the front wall 28 to the main body 32. For example, the front wall 28 can include one or more recessions 44 that mate with projections 46 present on a receiving portion 48 of the main body 32. After emptying the compartment 30, the user can replace the front wall 28 containing the internal compartment 30 such that it again defines the storage space 26 with the main body 32, reforming the storage bin 20.

The front wall 28 can include one or more openings 52 for allowing the collected caps to exit the internal compartment 30. In the present embodiment, the openings 52 are in the rear of the front wall 28, however, in some examples, the openings 52 can be located on any side of the front wall without departing from the scope of the invention. As shown, one or more front-facing sides 54 of the main body 32 can act to seal the openings 52 when the front wall 28 is secured to the main body 32 to form the storage bin 20.

Figure 5:
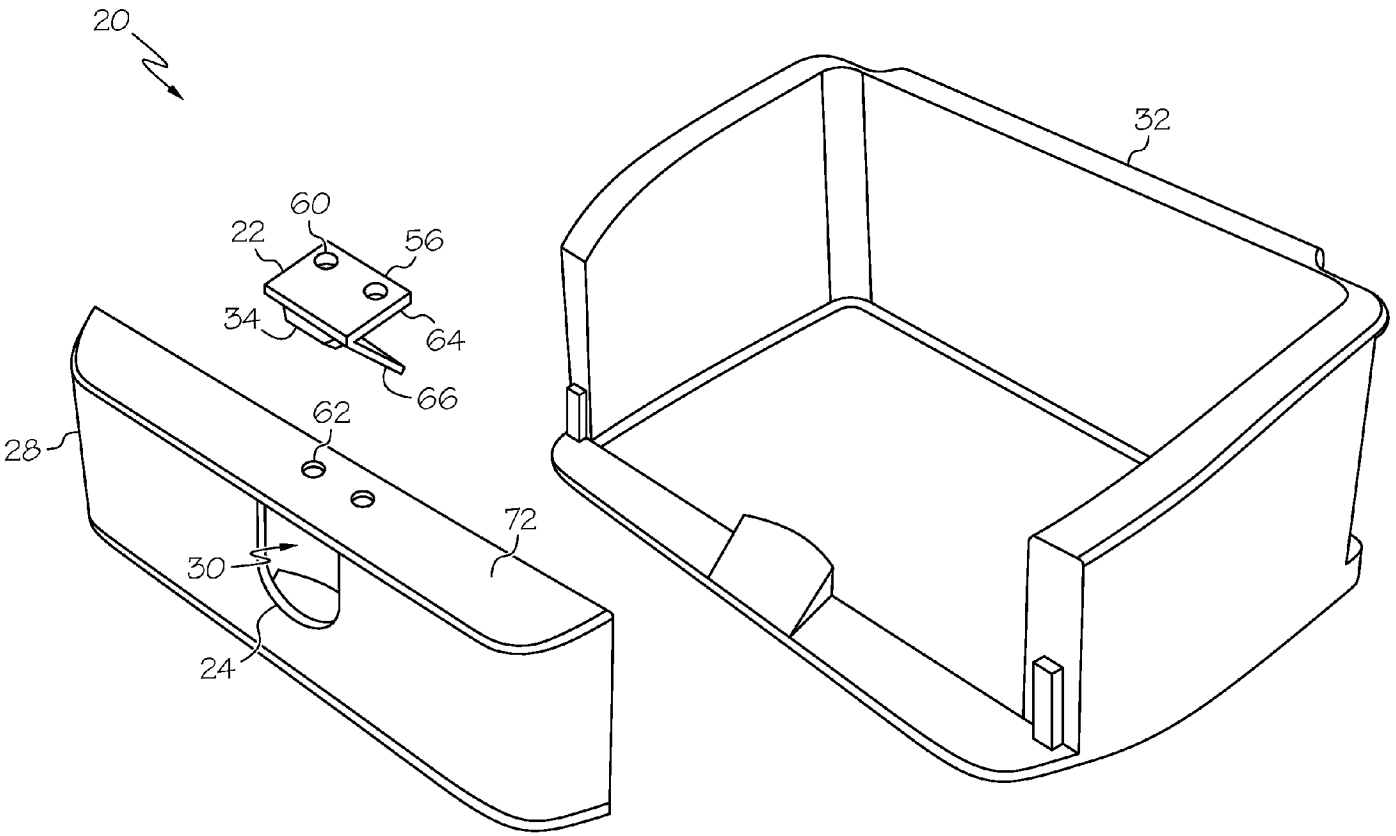
FIG. 5 is an exploded view of a storage bin including a front wall and opener.

As shown in FIG. 5, the opener 22 can comprise a bracket member 56 and an opener member 34. In some cases the opener member 34 and the bracket member 56 can be integral with each other. In some examples the opener member 34 and the bracket member 56 are separately attached. The bracket member 56 can be an angle bracket having a first member 64 and a second member 66 which meet to form an acute angle. In another example, the angle may be a right angle or an obtuse angle. In a preferred embodiment, the first and second members 64, 66 meet each other an angle such that, upon removal, a cap removed by the opener member 34 is positioned within the internal compartment 30 and thus falls into the compartment 30 for storage.

As illustrated, the opener 22 can be attachable to the front wall 28 of the storage bin 20. The attachment can be such that the opener 22 would not be removed during normal use. That is, in a preferred embodiment the bottle opener 22 could be used to open a bottle without removing the bottle opener 22 from the front wall 28. In one embodiment, the first member 64 of the bracket 56 can be fastened to the top side 72 of the front wall 28 using fasteners or the like. For example the first member 64 can comprise one or more apertures 60 through which thread members can be inserted. As illustrated, the top side 72 of the front wall 28 can include one or more apertures 62 through which thread members can be inserted. In a preferred embodiment, the bracket aperture 60 and the front wall aperture 62 align such that thread members or the like can be inserted through the apertures 60, 62 in order to attach the bracket member 56 and the front wall 28 to one another.

It is contemplated that the bottle opener 22 can comprise various shapes and sizes that can be inserted into the front wall 28 to open a capped bottle. In addition, it is contemplated that a bottle opener 22 can be incorporated into the storage bin 20 in any possible manner that can allow the bottle opener 22 to engage and open a capped bottle. The arrangement herein described may allow a consumer to take a capped bottle from the storage bin 20 and open the capped bottle using the bottle opener 22 attached to the front wall 28. It is noted that the capped bottle can be positioned in substantially a vertical plane when the cap is removed, thus avoiding spilling of any of the contents of the bottle.

In a preferred embodiment, the storage module is configured such that it can be removably attached to an interior portion of the refrigerator. The back side of the storage module can include an attachment portion, for example one or more hooks (not shown) which enable the storage module to move back and forth freely on the rail system built into the inside door of the food or freezer compartment. In a preferred embodiment, the back side of the storage module also includes at least one rubber stopper member (not shown) which prevents the storage module from moving around too freely on the rail system. In one embodiment, the rail system includes one or more channels that run along the inside portion of a refrigerator door.

It will be apparent to those skilled in the art that various modifications and variations can be made without departing from the spirit and scope of the claimed invention. Example embodiments incorporating one or more aspects of the invention are intended to include all such modifications and alterations insofar as they come within the scope of the appended claims.

What is claimed is:

1. A storage module for storing a closed beverage container within a refrigerator comprising:

a storage bin, wherein the storage bin comprises one or more walls and a bottom defining a storage space;

an opener configured to remove a closing member of the closed beverage container from the closed beverage container; and a compartment portion positioned to capture the removed closing member when the closed beverage container is opened with the opener, wherein the compartment portion is an enclosed environment within a selected wall of the one or more walls of the storage bin, spans a majority of a lateral distance of the selected wall, and is configured to contain the removed closing member within the enclosed environment, the selected wall includes an opening therethrough configured to provide access to the enclosed environment, wherein the opening is sufficient to receive a portion of the closed beverage container having the closed member, the opener is disposed within the enclosed environment of the selected wall and positioned to be in registry with the opening of the selected wall, wherein the opener comprises an angle bracket and an opener member, and wherein the opener member is incorporated into the angle bracket, and further wherein the angle bracket is affixed to the selected wall, the selected wall is removably coupled to the storage bin such that the user can detach the selected wall from a main body portion of the storage bin to empty the contents of the compartment portion within the selected wall, and the angle bracket comprises a first member and a second member which meet to form an acute angle, and further wherein the second member comprises the opener member.

2. The storage module of claim 1, wherein the angle bracket is affixed to a top portion of the selected wall of the storage bin.

3. The storage module of claim 1, wherein the second member of the angle bracket is positioned such that the removed closing member falls into the compartment portion when the closed beverage container is opened with the opener member.

4. The storage module of claim 1, wherein the selected wall is transparent.

5. The storage module of claim 1, wherein the selected wall comprises one or more apertures positioned such that the contents of the compartment portion can exit through the one or more apertures.

6. The storage module of claim 5, wherein the one or more apertures are positioned on a rear portion of the selected wall such that one or more surfaces of the main body of the storage bin seal the one or more apertures when the selected wall is attached to the main body.

7. A storage module for storing a closed beverage container within a refrigerator comprising:

a storage bin, wherein the storage bin comprises one or more walls and a bottom defining a storage space;

an opener affixed to the storage bin, wherein the opener is configured to remove a closing member of the closed beverage container from the closed beverage container;

an attachment portion configured to removably attach the storage bin to a side of the refrigerator; and a compartment portion positioned to capture the removed closing member when the closed beverage container is opened with the opener, wherein the compartment portion is an enclosed environment within a selected wall of the one or more walls of the storage bin, spans a majority of a lateral distance of the selected wall, and is configured to contain the removed closing member within the enclosed environment, the selected wall includes an opening configured to provide access to the enclosed environment, wherein the opening is sufficient to receive a portion of the closed beverage container having the closed member, the selected wall of the storage bin is removably coupled to the storage bin such that the user can remove the selected wall from a main body of the storage bin to empty the contents of the compartment portion contained therein, the opener is disposed within the enclosed environment of the selected wall and positioned to be in registry with the opening of the selected wall, wherein the opener comprises an angle bracket and an opener member, and wherein the opener member is incorporated into the angle bracket, further wherein the opener member is positioned such that the removed closing member falls into the compartment portion when the closed beverage container is opened with the opener member, and the angle bracket comprises a first member and a second member which meet to form an acute angle, and further wherein the second member comprises the opener member.

8. A refrigerator comprising:

a refrigerator cabinet comprising a door; and a storage module for storing a closed beverage container, wherein the storage module is attached to an interior side of the refrigerator door, and comprising:

a storage bin, wherein the storage bin comprises one or more walls and a bottom defining a storage space, an opener configured to remove a closing member of the closed beverage container from the closed beverage container, and a compartment portion positioned to capture the removed closing member when the closed beverage container is opened with the opener, wherein the compartment portion is an enclosed environment within a selected wall of the one or more walls of the storage bin, spans a majority of a lateral distance of the selected wall, and is configured to contain the removed closing member within the enclosed environment, the selected wall includes an opening configured to provide access to the enclosed environment, wherein the opening is sufficient to receive a portion of the closed beverage container having the closed member, the opener is disposed within the enclosed environment of the selected wall and positioned to be in registry with the opening of the selected wall, wherein the opener comprises an angle bracket and an opener member, and wherein the opener member is incorporated into the angle bracket, and wherein the opener member is positioned such that the removed closing member falls into the compartment portion when the closed beverage container is opened with the opener member, the selected wall of the storage bin is removably coupled to the storage bin such that the user can remove the selected wall from a main body of the storage bin to empty the contents of the compartment portion contained therein, and wherein the angle bracket comprises a first member and a second member which meet to form an acute angle, and further wherein the second member comprises the opener member.

9. The refrigerator of claim 8, wherein the selected wall incorporating the opener comprises one or more apertures positioned such that the contents of the compartment portion can exit through the one or more apertures.

* * * * *